US009535344B2

(12) United States Patent
Toriu et al.

(10) Patent No.: US 9,535,344 B2
(45) Date of Patent: Jan. 3, 2017

(54) PHOTOCONDUCTOR, IMAGE-FORMING APPARATUS, AND CARTRIDGE

(71) Applicants: Noboru Toriu, Shizuoka (JP); Hideki Nakamura, Yamanashi (JP); Tadayoshi Uchida, Yamanashi (JP); Hiroki Orii, Yamanashi (JP)

(72) Inventors: Noboru Toriu, Shizuoka (JP); Hideki Nakamura, Yamanashi (JP); Tadayoshi Uchida, Yamanashi (JP); Hiroki Orii, Yamanashi (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/974,463

(22) Filed: Dec. 18, 2015

(65) Prior Publication Data

US 2016/0187792 A1 Jun. 30, 2016

(30) Foreign Application Priority Data

Dec. 26, 2014 (JP) ..... 2014-264601

(51) Int. Cl.
*G03G 5/04* (2006.01)

(52) U.S. Cl.
CPC ..... *G03G 5/04* (2013.01)

(58) Field of Classification Search
CPC ..... G03G 5/04
USPC ..... 399/159
See application file for complete search history.

(56) References Cited

U.S. PATENT DOCUMENTS

| | | | | |
|---|---|---|---|---|
| 4,772,525 | A | 9/1988 | Badesha et al. | |
| 4,801,517 | A | 1/1989 | Frechet et al. | |
| 4,806,444 | A | 2/1989 | Yanus et al. | |
| 4,818,650 | A | 4/1989 | Limburg et al. | |
| 4,871,634 | A | 10/1989 | Limburg et al. | |
| 5,006,633 | A | 4/1991 | Shikatani et al. | |
| 5,011,939 | A | 4/1991 | Limburg et al. | |
| 5,278,014 | A | 1/1994 | Tamaki et al. | |
| 6,143,452 | A | 11/2000 | Sakimura et al. | |
| 2010/0316423 | A1* | 12/2010 | Kami | G03G 5/0592 399/346 |
| 2011/0200924 | A1* | 8/2011 | Kami | G03G 21/00 430/56 |
| 2012/0008984 | A1 | 1/2012 | Kami et al. | |
| 2012/0237228 | A1 | 9/2012 | Kami | |

FOREIGN PATENT DOCUMENTS

| | | |
|---|---|---|
| JP | 52-36016 | 3/1977 |
| JP | 54-9632 | 1/1979 |
| JP | 54-11737 | 1/1979 |
| JP | 57-78402 | 5/1982 |
| JP | 63-285552 | 11/1988 |
| JP | 64-1728 | 1/1989 |
| JP | 64-13061 | 1/1989 |
| JP | 64-19049 | 1/1989 |
| JP | 1-105260 | 4/1989 |

(Continued)

*Primary Examiner* — Clayton E Laballe
*Assistant Examiner* — Victor Verbitsky
(74) *Attorney, Agent, or Firm* — Oblon, McClelland, Maier & Neustadt, L.L.P.

(57) ABSTRACT

A photoconductor is used for an image-forming apparatus, and the photoconductor has a surface including irregularities having an arithmetic average roughness of 0.1 μm or more and 0.5 μm or less in a cycle length from 867 to 1,654 μm.

9 Claims, 8 Drawing Sheets

(56) References Cited

FOREIGN PATENT DOCUMENTS

| | | |
|---|---|---|
| JP | 2-167335 | 6/1990 |
| JP | 3-50555 | 3/1991 |
| JP | 3-192265 | 8/1991 |
| JP | 4-183719 | 6/1992 |
| JP | 5-19497 | 1/1993 |
| JP | 5-40350 | 2/1993 |
| JP | 5-66598 | 3/1993 |
| JP | 5-70595 | 3/1993 |
| JP | 5-158250 | 6/1993 |
| JP | 6-51544 | 2/1994 |
| JP | 2000-171990 | 6/2000 |
| JP | 2001-265014 | 9/2001 |
| JP | 2001-289630 | 10/2001 |
| JP | 2007-121908 | 5/2007 |
| JP | 2007-292772 | 11/2007 |
| JP | 2010-244002 | 10/2010 |
| JP | 2011-2480 | 1/2011 |
| JP | 2012-63720 | 3/2012 |
| JP | 2012-208468 | 10/2012 |

* cited by examiner

PHOTOCONDUCTOR, IMAGE-FORMING APPARATUS, AND CARTRIDGE

CROSS-REFERENCE TO RELATED APPLICATION

The present application is based on and claims priority to Japanese patent application No. 2014-264601, filed Dec. 26, 2014, the disclosure of which is hereby incorporated by reference herein in its entirety.

BACKGROUND

Technical Field

The present invention relates to a photoconductor, image-forming apparatus, and cartridge.

Description of Related Art

An image-forming apparatus such as an electrophotographic printer, copier, and facsimile, that forms an image with charging, exposing, developing, and cleaning processes, has been conventionally known. Such an image-forming apparatus uses a photoconductor. A method of extending an operating life of a photoconductor has been known.

Patent Literature 1 (Japanese Laid-Open Patent Application No. 2011-2480) teaches a photoconductor including a cross-linked resin surface layer containing a cross-linked resin having a charge transport structure. Multiresolution analysis is conducted to the surface of the photoconductor. Such a photoconductor satisfies an inequation of $0.01<WRa$ (μm)$<0.04$, where WRa represents an arithmetic average roughness of frequency components each having a cycle length (μm) of from 53 to 183, 106 to 318, 214 to 551, and 431 to 954. The photoconductor also has an arithmetic average roughness of a frequency component having a cycle length (μm) of from 53 to 183 larger than an arithmetic average roughens of frequency components each having a cycle length (μm) of from 0 to 3, 1 to 6, 2 to 13, 4 to 25, 10 to 50, and 26 to 106.

SUMMARY

However, the smoothness of the surface of the photoconductor taught by Patent Literature 1 may not be improved.

To solve the above problem, it is an object of the present invention to improve the smoothness of the surface of the photoconductor.

To achieve the above object, an aspect of the present invention provides a photoconductor for use in an image-forming apparatus, the photoconductor having a surface including irregularities having an arithmetic average roughness of 0.1 μm or more and 0.5 μm or less in a cycle length from 867 to 1,654 μm.

DETAILED DESCRIPTION

Figure 1:
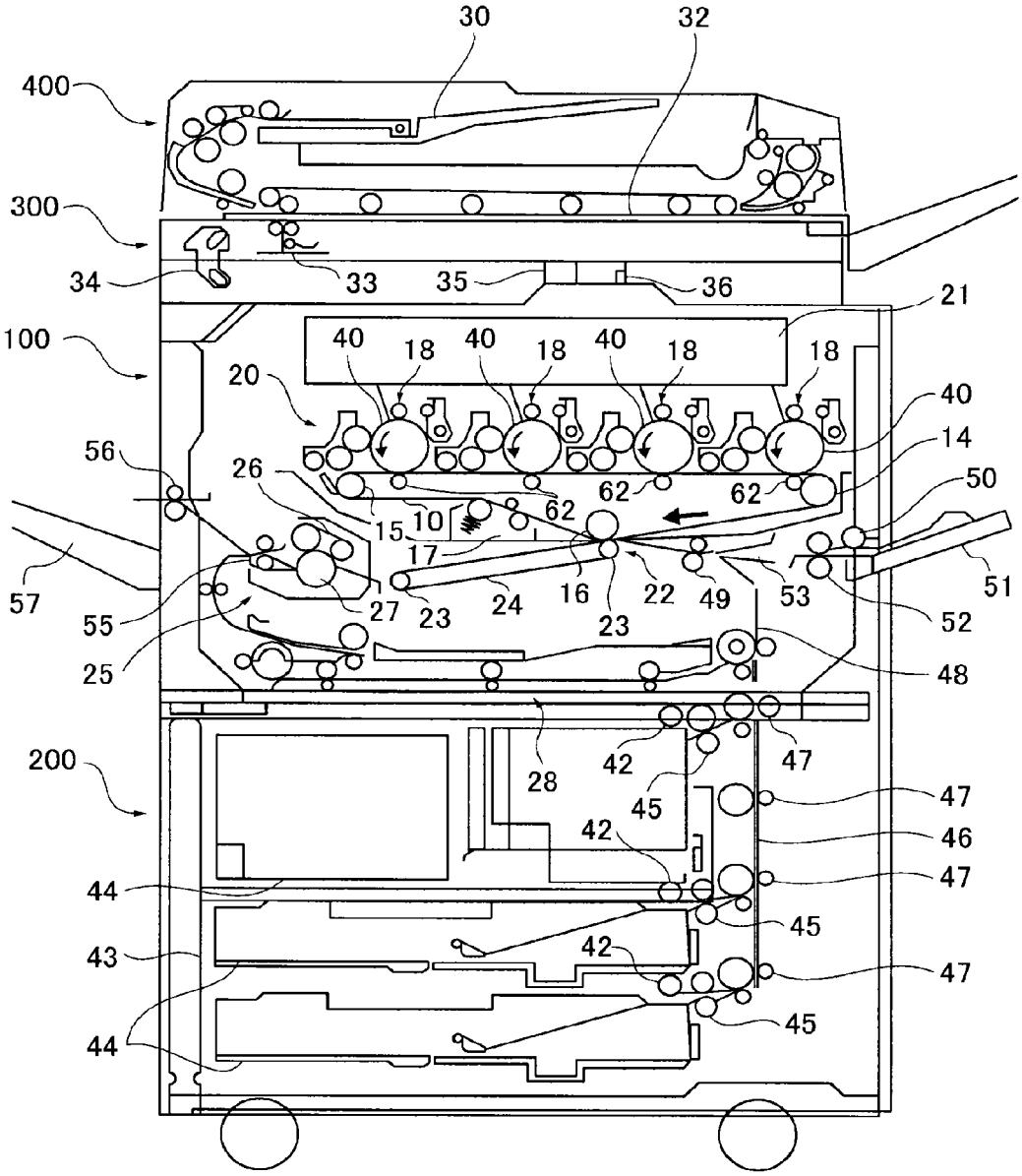
FIG. 1 is a schematic view showing an entire configuration of an image-forming apparatus according to an embodiment of the present invention.

Hereinafter, an embodiment of the present invention is described with reference to the drawings.

An image-forming apparatus according to the embodiment of the present invention is described below with reference to FIG. 1.

Reference number 100 denotes a tandem electrophotogrphic image-forming apparatus including a secondary transfer mechanism to form a color image. The image-forming apparatus 100 is hereinafter described.

The image-forming apparatus 100 includes an intermediate transfer unit. The intermediate transfer unit includes an endless intermediate transfer belt 10. In FIG. 1, the intermediate transfer belt 10 is wound around three support rollers 14, 15, and 16 to rotate in the clockwise direction.

An intermediate transfer body cleaning unit 17 cleans toner remained on the intermediate transfer belt 10 after an image-forming process.

Each of image-forming devices 20 includes a cleaning unit 13, charging unit 18, neutralization unit 19, developing unit 29, and photoconductor unit 40.

In FIG. 1, the image-forming apparatus 100 includes four image-forming devices 20 corresponding to yellow (Y), mazenta (M), cyan (C), and black (K), respectively.

The image-forming devices 20 are disposed between the first support roller 14 and the second support roller 15 in order of yellow (Y), mazenta (M), cyan (C), and black (K) in the feeding direction of the intermediate transfer belt 10 in FIG. 1. The image-forming devices 20 can be detachably attached to the image-forming apparatus 100.

An optical beam scanner 21 irradiates photoconductor drums of the photoconductor units 40 of the respective colors with optical beams.

A secondary transfer unit 22 includes two rollers 23 and a secondary transfer belt 24.

The secondary transfer belt 24 is an endless belt. The secondary transfer belt 24 is wound around the two rollers 23 to rotate. In FIG. 1, the rollers 23 and the secondary transfer belt 24 push up the intermediate transfer belt 10 to be pressed to the third support roller 16.

The secondary transfer belt 24 transfers an image formed on the intermediate transfer belt 10 onto a recording medium such as a paper sheet and a plastic sheet.

A fixing unit 25 performs a fixing process. The fixing unit 25 includes a fixing belt 26 as an endless belt and a pressure roller 27. The fixing belt 26 and the pressure roller 27 are disposed such that the pressure roller 27 is pressed to the fixing belt 26. The recording medium on which a toner image is transferred is fed to the fixing unit 25. The fixing unit 25 heats the recording medium to fix the image on the recording medium.

A sheet reversing unit 28 turns over front and rear planes of the recording medium. For example, when an image is formed on the rear plane after an image is formed on the front plane, the sheet reversing unit 28 is used.

When a start button of an operation unit is pressed and the recording medium is placed on a paper feeding base 30, an Auto Document Feeder (ADF) 400 feeds the recording medium on a contact glass 32. On the other hand, when the recording medium is not placed on the paper feeding base 30, the ADF 400 starts up an image reading unit 300 that reads the recording medium on the contact glass 32 placed by a user.

The image reading unit 300 includes a first carriage 33, second carriage 34, imaging forming lens 35, Charge Coupled Device (CCD) 36, and light source.

The image reading unit 300 operates the first and second carriages 33 and 34 to read the recording medium on the contact glass 32.

A light source of the first carriage 33 emits light toward the contact glass 32. Next, the light emitted from the light source of the first carriage 33 reflects on the recording medium on the contact glass 32. The reflected light reflects on a first mirror of the first carriage 33 toward the second carriage 34. Next, the light reflected toward the second carriage 34 passes through the imaging forming lens 35 to be imaged on the CCD 36 as a reading sensor.

The image-forming apparatus 100 creates image data corresponding to Y, M, C, and K by the CCD 36.

The image-forming apparatus 100 rotates the intermediate transfer belt 10 when a start button of the operation unit is pressed or in response to an image-forming instruction from an external device such as a personal computer (PC). The image-forming apparatus 100 rotates the intermediate transfer belt 10 in response to an output instruction of a facsimile.

The image-forming device 20 starts an image-forming process when the intermediate transfer belt 10 rotates. The recording medium on which the toner image is transferred is fed to the fixing unit 25. Next, an image is formed on the recording medium by the fixing process of the fixing unit 25.

A paper feeding table 200 includes paper feeding rollers 42, a paper feeding unit 43, separation rollers 45, and a feeding roller unit 46. The paper feeding unit 43 may include a plurality of paper feeding trays 44. The feeding roller unit 46 includes feeding rollers 47.

The paper feeding table 200 selects one paper feeding roller 42, and then rotates the selected paper feeding roller 42.

The paper feeding unit 43 selects one paper feeding tray 44, and feeds the recording medium from the paper feeding tray 44. Next, the fed recording medium is separated by the separation rollers 45, and enters the feeding roller unit 46. The feeding roller unit 46 feeds the recording medium to the image-forming apparatus 100 by the feeding rollers 47.

Next, the feeding roller unit 46 feeds the recording medium to a registration roller 49. The recording medium fed to the registration roller 49 has contact with the registration roller 49. Then, the recording medium is fed to the secondary transfer unit 22 in transfer timing in a predetermined position when the toner image enters the secondary transfer unit 22.

Note that the recording medium may be fed from a manual paper feeding tray 51. In this case, when the recording medium is fed from the manual paper feeding tray 51, the image-forming apparatus 100 rotates paper feeding rollers 50 and 52. Next, the paper feeding rollers 50 and 52 separate one recording medium from recording media on the manual paper feeding tray 51. The paper feeding rollers 50 and 52 feed the separated recording medium to a paper feeding path 53. The recording medium fed to the paper feeding path 53 is fed to the registration roller 49. After the recording medium is fed to the registration roller 49, the same processes as the processes when the recording medium is fed from the paper feeding table 200 are conducted.

The recording medium is fixed by the fixing unit 25, and is ejected from the image-forming apparatus 100. The recording medium ejected from the fixing unit 25 is fed to an ejection roller 56 by a switching claw 55. The ejection roller 56 feeds the fed recording medium to a paper ejection tray 57.

The switching claw 55 may feed the recording medium ejected from the fixing unit 25 to the sheet reversing unit 28. In this case, the sheet reversing unit 28 turns over the front plane of the fed recording medium. Then, an image is formed on the rear plane of the recording medium similar to the front plane for both-sided printing, and the recording medium is fed to the paper ejection tray 57.

On the other hand, the toner remained on the intermediate transfer belt 10 is removed by the intermediate transfer body cleaning unit 17. After the toner remained on the intermediate transfer belt 10 is removed, the image-forming apparatus 100 is prepared for next image formation.

The image-forming apparatus 100 may use five or more colors for forming an image. In addition, when the image-forming apparatus 100 uses five or more colors, the image-forming apparatus 100 changes the number of image-forming devices 20 according to the number of colors. Hereinafter, the image-forming apparatus 100 including the image-forming devices 20 that forms an image with four colors of yellow (Y), magenta (M), cyan (C), and black (K) is described.

Figure 2:
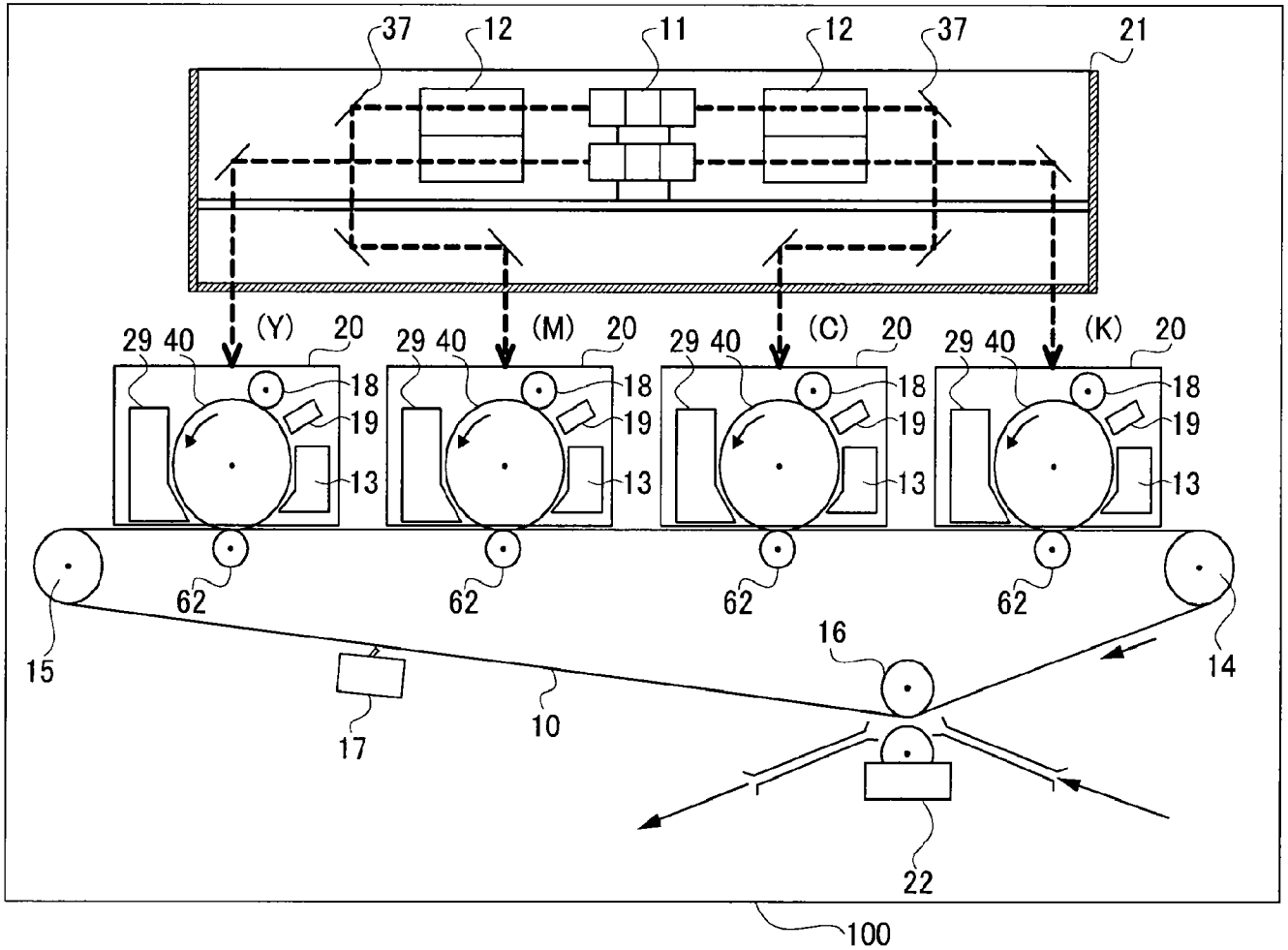
FIG. 2 is a schematic view showing an image-forming process by the image-forming apparatus according to the embodiment of the present invention.

FIG. 2 is a schematic view illustrating an image-forming process by the image-forming apparatus according to the embodiment of the present invention.

The image-forming apparatus 100 includes the intermediate transfer belt 10, the image-forming devices 20 corresponding to the respective colors, the optical beam scanner 21 corresponding to the respective colors, the intermediate transfer body cleaning unit 17, and the secondary transfer unit 22.

The optical beams are incident on the image-forming devices 20 from the optical beam scanner 21. Next, each of the image-forming devices 20 conducts the image-forming process with the incident optical beams. In the electrophotographic image-forming process, five processes of a charging process, exposing process, developing process, transferring process, and fixing process are conducted. The image-forming process includes the charging process, exposing process, developing process, and transferring process.

The image-forming devices 20 form toner images of respective colors on the intermediate transfer belt 10 in the image-forming process. The toner images of the respective colors formed by the image-forming devices 20 are sequentially superimposed to form a color toner image.

The optical beams modulated based on the image data are incident on the photoconductor units 40 of the image-forming devices 20.

Each of the charging units 18 conducts the charging process of charging the surface of the photoconductor unit 40 with the charging unit 18.

The exposing process of forming an electrostatic latent image on the surface of the photoconductor unit 40 is conducted to the charged photoconductor unit 40 with the optical beams.

Each of the developing units 29 conducts the developing process of transferring the toner onto the electrostatic latent image formed on the photoconductor unit 40 to form the toner image. In this case, the toner is supplied to the developing unit 29 from a toner bottle.

The toner image is transferred onto the intermediate transfer belt 10 by transfer units 62.

The toner images of the respective colors are superimposed on the intermediate transfer belt 10, and are transferred onto the recording medium as one toner image. After the transferring, the neutralization unit 19 neutralizes the photoconductor unit 40, and the cleaning unit 13 removes the toner image.

When the transferred toner image enters the secondary transfer unit 22, the recording medium is fed to the secondary transfer unit 22. Next, the toner image on the intermediate transfer belt 10 is transferred onto the recording medium fed to the secondary transfer unit 22.

The secondary transfer unit 22 transfers the color toner image formed on the intermediate transfer belt 10 onto the recording medium. After that, the fixing unit 25 conducts the fixing process.

After the transferring process, the intermediate transfer body cleaning unit 17 removes the color toner image.

The photoconductor is for example the photoconductor unit 40 illustrated in FIG. 2. The photoconductor includes a conductive supporting body. In this case, the conductive supporting body which is the surface of the photoconductor includes irregularities. The details of the photoconductor are described later.

The photoconductor may be used for a cartridge.

Figure 3:
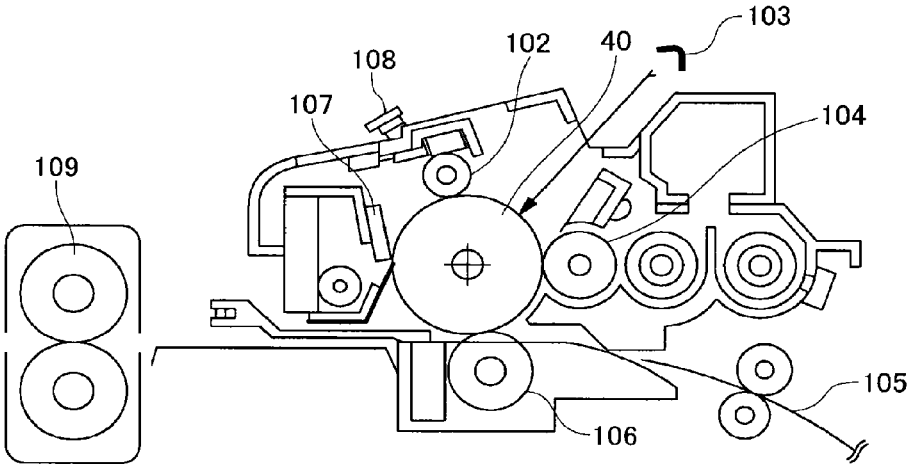
FIG. 3 is a schematic view showing a cartridge according to the embodiment of the present invention.

Next, the cartridge according to the embodiment of the present invention is described. FIG. 3 is a view illustrating the cartridge according to the embodiment of the present invention.

The cartridge includes inside thereof the photoconductor, and may include a charger, exposing device, developing device, transferring device, cleaner, and neutralizer. Namely, the cartridge integrally includes the photoconductor and the developing device that develops the electrostatic latent image formed on the photoconductor by toner. The cartridge is detachably attached to the image-forming apparatus.

The cartridge is used for example IMAGIO™ MF 200 manufactured by RICOH Co., Ltd. FIG. 3 shows the cartridge used for IMAGIO. FIG. 3 also shows the image-forming apparatus using the cartridge. Hereinafter, this apparatus is described.

The photoconductor is charged by a charging device 102 as one example of the charger. After the photoconductor is charged, the photoconductor unit 40 is exposed by an exposing device 103 as one example of the exposing device. Electric charge is thereby generated on the exposed portion, and the electrostatic latent image is formed on the surface of the photoconductor. Next, the photoconductor unit 40 has contact with developer via a developing device 104 as one example of the developing device, and forms the toner image. The toner image formed on the surface of the photoconductor is transferred onto a transferred body 105 such as paper by a transfer device 106 as one example of the transfer device, and passes through a fixing device 109 as one example of the fixer to be hard copy.

The toner remained on the photoconductor unit 40 is removed by a cleaning blade 107. The remained electric charge is removed by a neutralization lamp 108. The image-forming apparatus conducts a next electrophotographic cycle. In addition, FIG. 3 shows the cartridge without including the transferred body 105, transfer device 106, neutralization lamp 108 as one example of the neutralizer, and fixing device 109.

On the other hand, FIG. 3 shows the light irradiation process including image exposure, exposure before cleaning, and neutralization exposure. The light irradiation process may include exposure before transferring, pre-exposure of an image, and a known irradiation process of directly irradiating the photoconductor.

Figure 4:
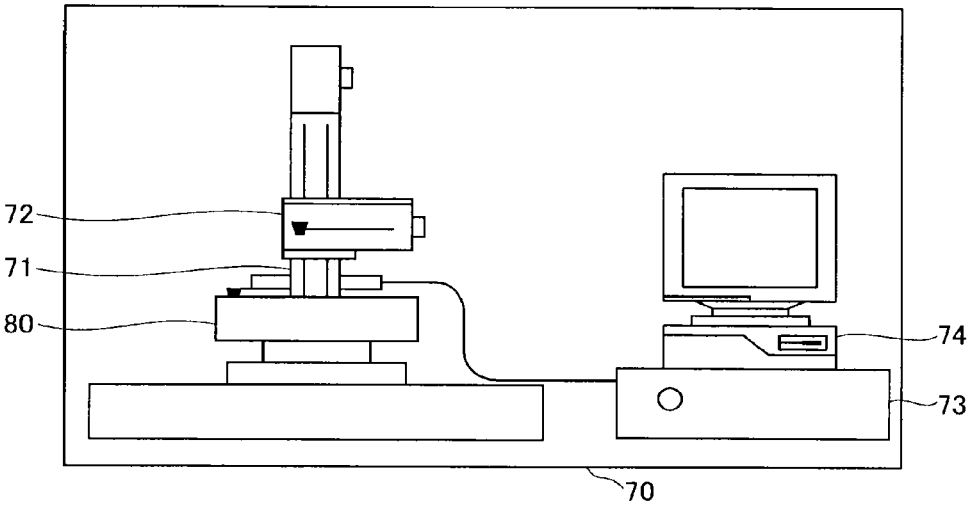
FIG. 4 is a schematic view showing an evaluation system that evaluates surface roughness of a photoconductor according to the embodiment of the present invention.

An evaluation example of surface roughness of the photoconductor is hereinafter described. FIG. 4 is a schematic view illustrating a system of evaluating the surface roughness of the photoconductor according to the embodiment of the present invention.

An evaluation system 70 includes a jig 71, moving mechanism 72, surface roughness and profile shape measuring instrument 73, and PC 74. A conductive supporting body 80 is used for the photoconductor.

The irregularities are represented by the roughness profile (JIS B0601 2001). In addition, the roughness profile is one-dimensional data array. In this case, the surface of the conductive supporting body 80 is evaluated based on wavelet transformation multiresolution analysis, for example.

The jig 71 includes a probe that measures the surface roughness of the conductive supporting body 80.

The moving mechanism 72 moves the jig 71 along the conductive supporting body 80 as the measurement target.

In this embodiment, as the surface roughness and profile shape measuring instrument 73, SURFCOM 1400D manufactured by TOKYO SETMTTSU CO., LTD. is used.

The PC 74 is connected to the surface roughness and profile shape measuring instrument 73 via a cable such as RS-232 (Recommended Standard 232), and obtains surface roughness data from the surface roughness and profile shape measuring instrument 73. The PC 74 conducts the multiresolution analysis (MRA-1) based on the surface roughness data.

The evaluation system 70 may be configured to conduct the multiresolution analysis with the surface roughness and profile shape measuring instrument 73.

The evaluation length is preferably 8 mm or more and 25 mm or less which is defined by JIS. The sampling interval is preferably 1 μm or less, and more preferable 0.2 μm or more and 0.5 μm or less. For example, when the evaluation length is 12 mm and the number of sampling points is 30,720, the sampling interval is 0.390625 μm.

The one-dimensional data array obtained from the surface roughness and profile shape measuring instrument 73 is separated into a plurality of frequency components by first wavelet transformation multiresolution analysis. More specifically, the frequency components include for example, a first frequency component (HHH), second frequency component (HI-IL), third frequency component (HMH), fourth frequency component (HML), fifth frequency component (HLH), and sixth frequency component (HLL). The first frequency component (HHH) has the highest frequency and the sixth frequency component (HLL) has the lowest frequency.

The one-dimensional data array of the sixth frequency component (HLL) having the lowest frequency is thinned by a thinning process of reducing the number of data arrays to from 1/10 to 1/100. When the thinning factor is larger than 1/10, for example, 1/5, the frequency of the data may not be increased sufficiently. In this case, second wavelet transformation multiresolution analysis may result in insufficient data separation. When the thinning factor is smaller than 1/100, for example, 1/200, the frequency of the data is increased too much. In this case, the second wavelet transformation multiresolution analysis may result in insufficient data separation such that the resulting frequency components concentrate at high frequencies. Therefore, the thinning factor is preferably from 1/10 to 1/100.

For example, when the one-dimensional data array including 30,000 data arrays obtained by the first wavelet transformation multiresolution analysis is thinned so that the number of data arrays is reduced to 1/10, the thinned one-dimensional data array includes 3,000 data arrays. Since the thinning process expands the scale width, the thinning process increases the frequency of the data.

Next, the thinned one-dimensional data array is further separated into a plurality of frequency components by second wavelet transformation multiresolution analysis.

More specifically, in the thinning process, the average value of the data of 100 points is calculated, and the average value calculated in the following process is used.

An arithmetic average roughness Ra (JIS B0601 2001) is calculated from the one-dimensional data of each of the separated frequency components in the multiresolution analysis.

The wavelet transformation is performed by a software such as MATLAB™ manufactured by MathWorks™, Inc.

Mother wavelet functions usable for the first and second wavelet transformation multiresolution analysis may be various wavelet functions for example, Daubecies function, Haar function, Meyer function, Symlet function, and Coiflet function. In addition, the number of frequency components separated by the wavelet transformation multiresolution analysis is preferably 4 or more and 8 or less, and more preferably 6 in view of evaluation accuracy and calculation costs.

In the multiresolution analysis, the wavelet transformation may be performed in multiple steps. When the frequency band as the measurement target is separated into a plurality of frequency bands by the wavelet transformation, a restoring process with inverse wavelet transformation may be performed.

FIGS. 5A to 5D are graphs showing measurement results and calculation results of the frequency components obtained by the multiresolution analysis according to the embodiment of the present invention. The calculation results shown in FIGS. 5A to 5D are obtained based on the data to which the second wavelet transformation multiresolution analysis is conducted after the thinning process with a thinning factor of 1/40 is conducted to the data having the lowest frequency obtained by the first wavelet transformation multiresolution analysis. More specifically, FIGS. 5A to 5D show the arithmetic average roughness Ra, maximum height Rz (JIS B0601 2001), and ten points average roughness RzJIS (JIS B0601 2001) calculated from the data to which the first wavelet transformation multiresolution analysis is conducted.

Figure 5A:
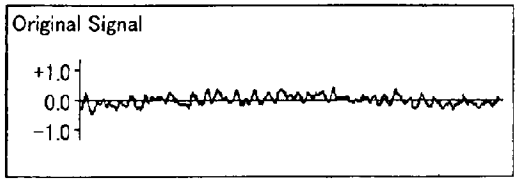
FIGS. 5A to 5D are graphs showing measurement results and calculation results of frequency components obtained by multiresolution analysis according to the embodiment of the present invention.

FIG. 5A is a graph showing the measurement results for the multiresolution analysis. Hereinafter, one example when the measurement results shown in FIGS. 5A to 5D are obtained is described.

FIG. 5A shows the measurement results obtained by the surface roughness and profile shape measuring instrument 73. For example, the measurement results are shown by a roughness profile (JIS B0601 2001). The measurement results shown in FIG. 5A are obtained in an evaluation length of 12 mm.

The frequency components separated by the second wavelet transformation multiresolution analysis include for example, a seventh frequency component (LHH), eighth frequency component (LHL), ninth frequency component (LMH), tenth frequency component (LML), eleventh frequency component (LLH), and twelfth frequency component (LLL).

In addition, the respective frequency components may have overlapped frequency bands.

Figure 5B:
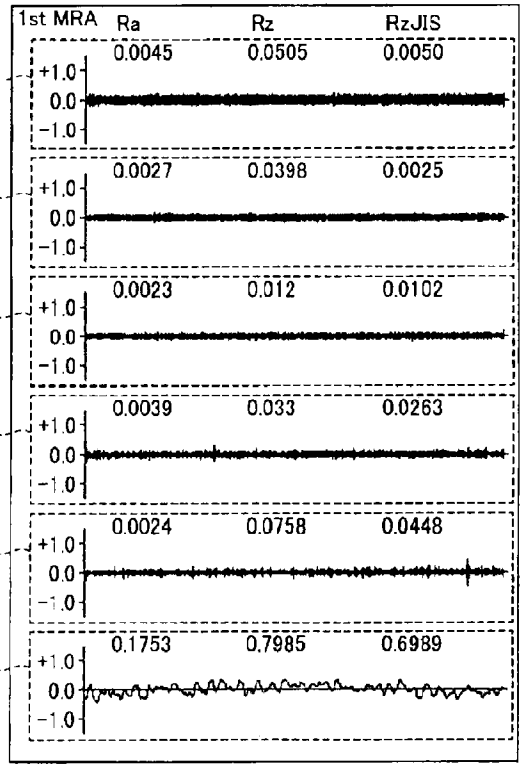

FIG. 5B shows the calculation results based on the data to which the first wavelet transformation multiresolution analysis is conducted. In FIG. 5B, the frequencies are shown in order from the highest frequency to the lowest frequency.

More specifically, in FIG. 5B, G1 shows the graph of the first frequency component (HHH) as the highest frequency component, G2 shows the graph of the second frequency component (HHL) as the second highest frequency component, G3 shows the graph of the third frequency component (HMH) as the third highest frequency component, G4 is the graph of the fourth frequency component (HML) as the fourth highest frequency component, G5 is the graph of the fifth frequency component (HLH) as the fifth highest frequency component, and G6 is the graph of the sixth frequency component (HLL) as the lowest frequency component.

Figure 6:
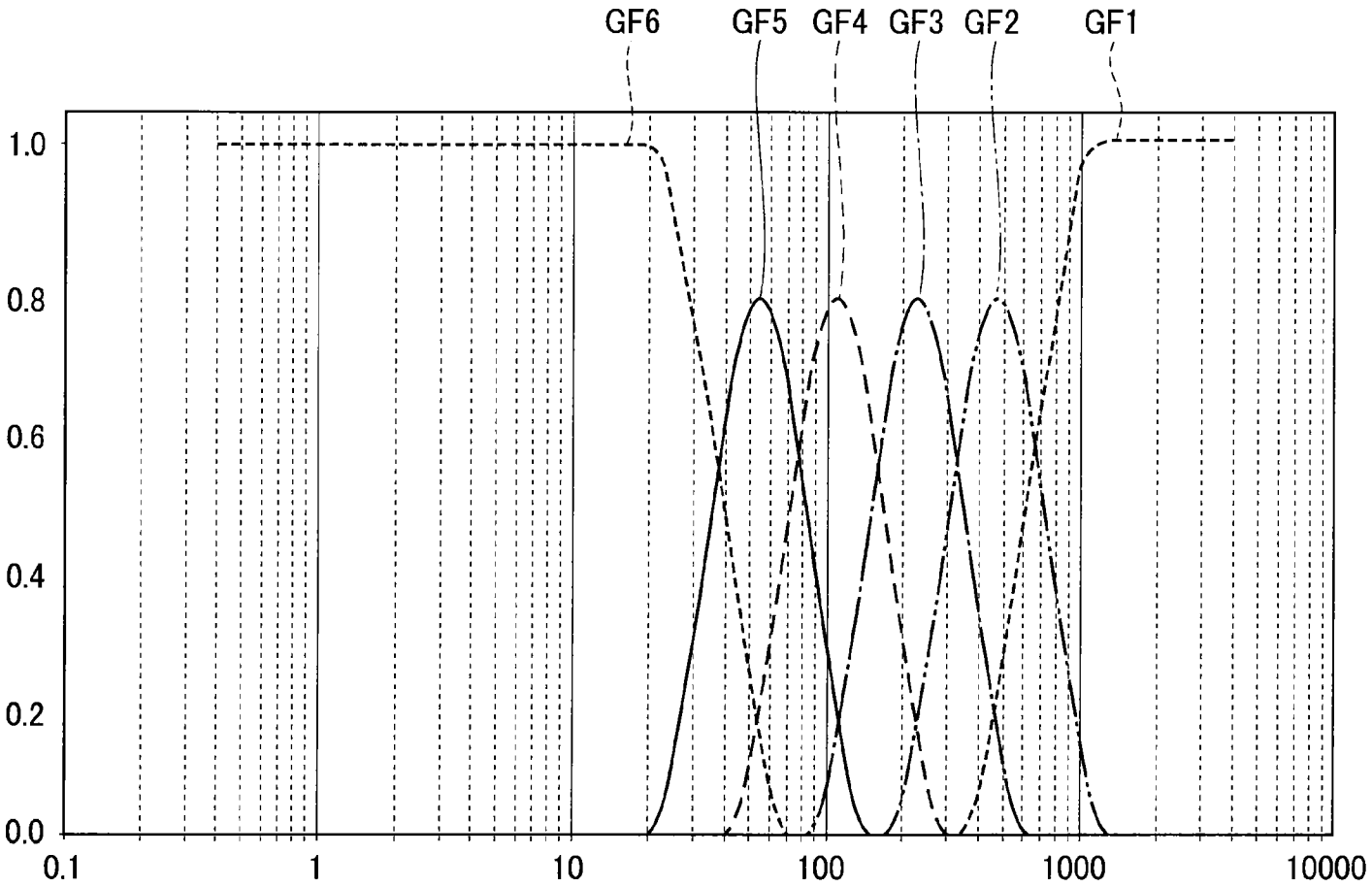
FIG. 6 is a graph showing separated frequency components obtained by first wavelet transformation multiresolution analysis according to the embodiment of the present invention.

FIG. 6 is a graph showing the separated frequency components by the multiresolution analysis according to the embodiment of the present invention. In FIG. 6, the horizontal axis represents the number of irregularities per 1 mm when the irregularities have a sine wave, and the vertical axis represents the ratio of each frequency band.

More specifically, in FIG. 6, a curve GF1 is the band of the first frequency component (HHH), a curve GF2 is the band of the second frequency component (HHL), a curve GF3 is the band of the third frequency component (HMH), a curve GF4 is the band of the fourth frequency component (HML), a curve GF5 is the band of the fifth frequency component (HLH), and a curve GF6 is the band of the sixth frequency component (HLL).

In FIG. 6, when the number of irregularities per 1 mm is 20 or less, the value represented by the curve GF6 is high. When the number of irregularities per 1 mm is 110, the value represented by the curve GF4 is high. The arithmetic average roughness Ra is represented by the graph G4 in FIG. 5B.

For example, when the number of irregularities per 1 mm is 220, the value represented by the curve GF3 is high. The arithmetic average roughness Ra is represented by the graph G3 in FIG. 5B.

When the number of irregularities per 1 mm is 310, the values represented by the curves GF2 and GF3 are high. The arithmetic average roughness Ra is represented by the graph G3 in FIG. 5B.

The graphs illustrated in FIG. 5B are determined based on the number of irregularities per 1 mm, namely, the surface roughness. Similarly, the curves in FIG. 6 are determined based on the number of irregularities per 1 mm, namely, the surface roughness. Since fine irregularities have a high frequency, such irregularities are shown by a high frequency component. On the other hand, since coarse irregularities have a low frequency, such irregularities are shown by a low frequency component. The arithmetic average roughness Ra, maximum height Rz, and ten points average roughness RzJIS are calculated from the curves of the respective frequency bands.

Figure 7:
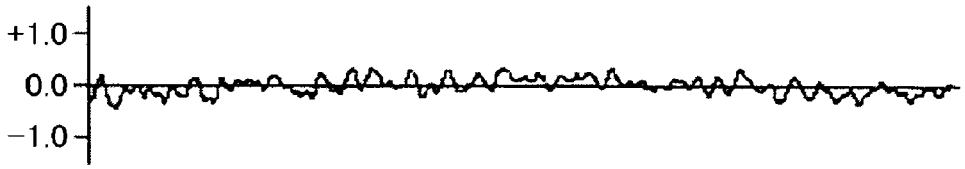
FIG. 7 is a graph showing a result of a thinning process according to the embodiment of the present invention.

In order to perform the second wavelet transformation multiresolution analysis, the data of the graph G6 of the sixth frequency component as the lowest frequency component is thinned. In this case, in the multiresolution analysis, a target frequency becomes the center of the band by the thinning process. FIG. 7 shows the results of the thinning process with the thinning factor of 1/40 shown in FIG. 5A.

FIG. 7 is a graph showing the results of the thinning process according to the embodiment of the present invention. The vertical axis represents the surface irregularity (μm) and the horizontal axis represents the evaluation length of 12 mm.

The second wavelet transformation multiresolution analysis is performed to the results of the thinning process shown in FIG. 7.

Figure 5C:
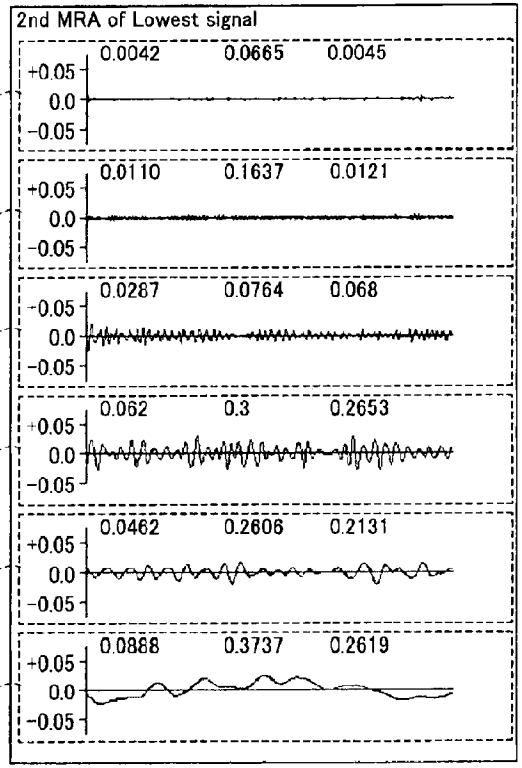

FIG. 5C shows the calculation results based on the data to which the second wavelet transformation multiresolution analysis is performed. FIG. 5C shows the frequency components in order from the highest frequency to the lowest frequency.

More specifically, G7 shows the graph of the seventh frequency component (LHH) as the highest frequency component, G8 shows the graph of the eighth frequency component (LHL) as the second highest frequency component, G9 shows the graph of the ninth frequency component (LMH) as the third highest frequency component, G10 shows the graph of the tenth frequency component (LML) as the fourth highest frequency component, G11 shows the graph of the eleventh frequency component (LLH) as the fifth highest frequency component, and G12 is the graph of the twelfth frequency component (LLL) as the lowest frequency component.

Figure 8:
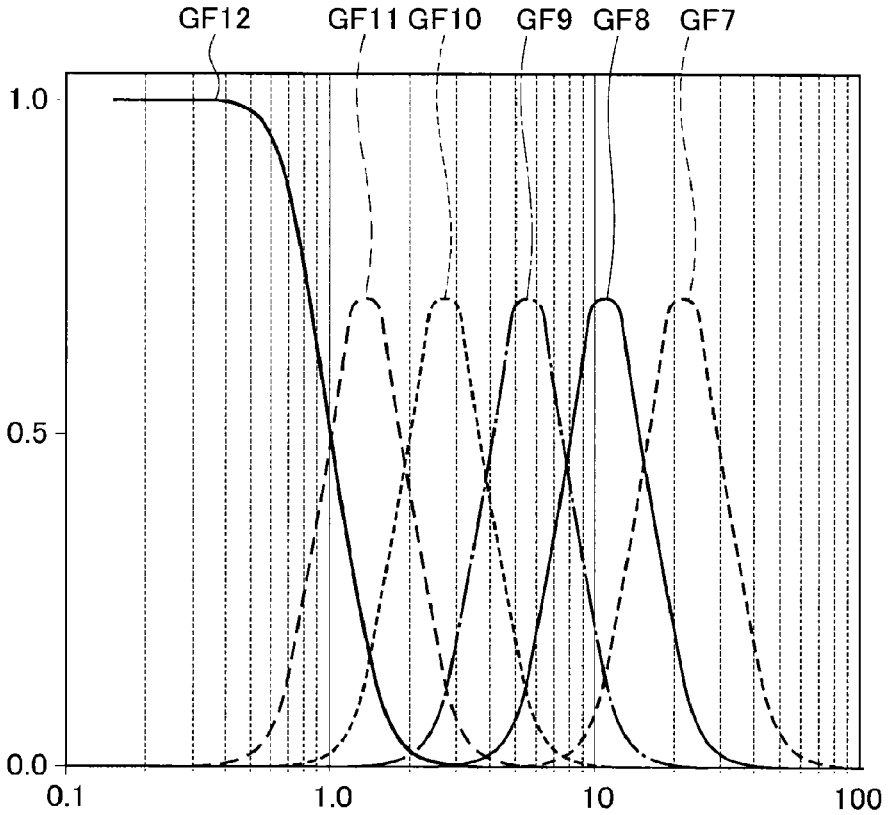
FIG. 8 is a graph showing separated frequency components obtained by second wavelet transformation multiresolution analysis according to the embodiment of the present invention.

FIG. 8 is a graph showing the separated frequency components obtained in the second wavelet transformation multiresolution analysis. The horizontal axis represents the number of irregularities per 1 mm when the irregularities have a sine wave and the vertical axis represents a ratio of each frequency band.

More specifically, a curve GF7 is the band of the seventh frequency component (LHH), a curve GF8 is the band of the eighth frequency component (LHL), a curve GF9 is the band of the ninth frequency component (LMH), a curve GF10 is the band of the tenth frequency component (LML), a curve GF11 is the band of the eleventh frequency component (LLH), and a curve GF12 is the band of the twelfth frequency component (LLL).

In FIG. 8, when the number of irregularities per 1 mm is 0.2 or less, the value represented by the curve GF12 is high. When the number of irregularities per 1 mm is 11, the value represented by the curve GF8 and the value represented by the graph G8 in FIG. 5C are high.

The graphs in FIG. 5C are determined based on the number of irregularities per 1 mm, namely, the surface roughness. Similarly, the curves in FIG. 8 are determined based on the number of irregularities per 1 mm, namely, the surface roughness. Since fine irregularities have a high frequency, such irregularities are shown by a high frequency component. On the other hand, since coarse irregularities have a low frequency, such irregularities are shown by a low frequency component. The arithmetic average roughness Ra, maximum height Rz, and ten points average roughness RzJIS are calculated from the curves of the respective frequency bands.

The following Table 1 shows the calculation results by the multiresolution analysis according to the embodiment of the present invention.

TABLE 1

| | | CALCULATION RESULT | | |
|---|---|---|---|---|
| MULTI-RESOLUTION ANALYSIS | SIGNAL | MAXI-MUM HEIGHT Rz | ARITHMETIC AVERAGE ROUGHNESS Ra | TEN POINTS AVERAGE ROUGHNESS RzJIS |
| $1^{ST}$ | HHH | 0.0045 | 0.0505 | 0.0050 |
| | HHL | 0.0027 | 0.0399 | 0.0025 |
| | HMH | 0.0023 | 0.0120 | 0.0102 |
| | HML | 0.0039 | 0.0330 | 0.0283 |
| | HLH | 0.0024 | 0.0758 | 0.0448 |
| | HLL | 0.1753 | 0.7985 | 0.6989 |
| $2^{ND}$ | LHH | 0.0042 | 0.0665 | 0.0045 |
| | LHL | 0.0110 | 0.1632 | 0.0121 |
| | LMH | 0.0287 | 0.0764 | 0.0660 |
| | LML | 0.0620 | 0.3000 | 0.2663 |
| | LLH | 0.0462 | 0.2606 | 0.2131 |
| | LLL | 0.0888 | 0.3737 | 0.2619 |

Table 1 shows the arithmetic average roughness Ra, maximum height Rz, and ten points average roughness RzJIS calculated from the curves of the frequency bands.

In Table 1, HHH has a cycle length of from 0 to 3 μm, HHL has a cycle length of from 1 to 6 HMH has a cycle length of from 2 to 13 μm, HML has a cycle length of from 4 to 25 μm, HLH has a cycle length of from 10 to 50 μm, HLL has a cycle length of from 24 to 99 μm, LHH has a cycle length of from 26 to 106 μm, LHL has a cycle length of from 53 to 183 μm, LMH has a cycle length of from 106 to 318 μm, LML has a cycle length of from 214 to 551 μm, LLH has a cycle length of from 431 to 954 μm, and LLL has a cycle length of from 867 to 1,654 μm.

Figure 5D:
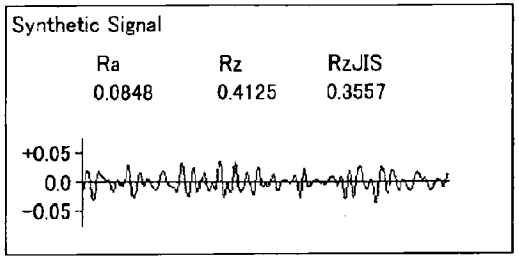

In FIG. 5D, an arithmetic average roughness WRa obtained from the results of the multiresolution analysis is plotted for each signal, and the profile is obtained by connecting the plots with a line. Since the sixth frequency component (HLL) has a prominent value, the surface roughness of the sixth frequency component, which is obtained from the results of the multiresolution analysis, is omitted. This profile is referred to as a surface roughness spectrum or a roughness spectrum. When the wavelet transformation is performed to the roughness profile of the sixth frequency component (HLL), the seventh frequency component (LHH) or the twelfth frequency component (LLL) is obtained. The information regarding the sixth frequency component (HLL) is reflected to the seventh frequency component (LHH) or the twelfth frequency component (LLL). Thus, the sixth frequency component (HLL) can be omitted.

The arithmetic average roughness WRa of the twelfth frequency component (LLL) is represented as the arithmetic average roughness WRa (LLL). In addition, the other frequency components are similarly represented.

Figure 9:
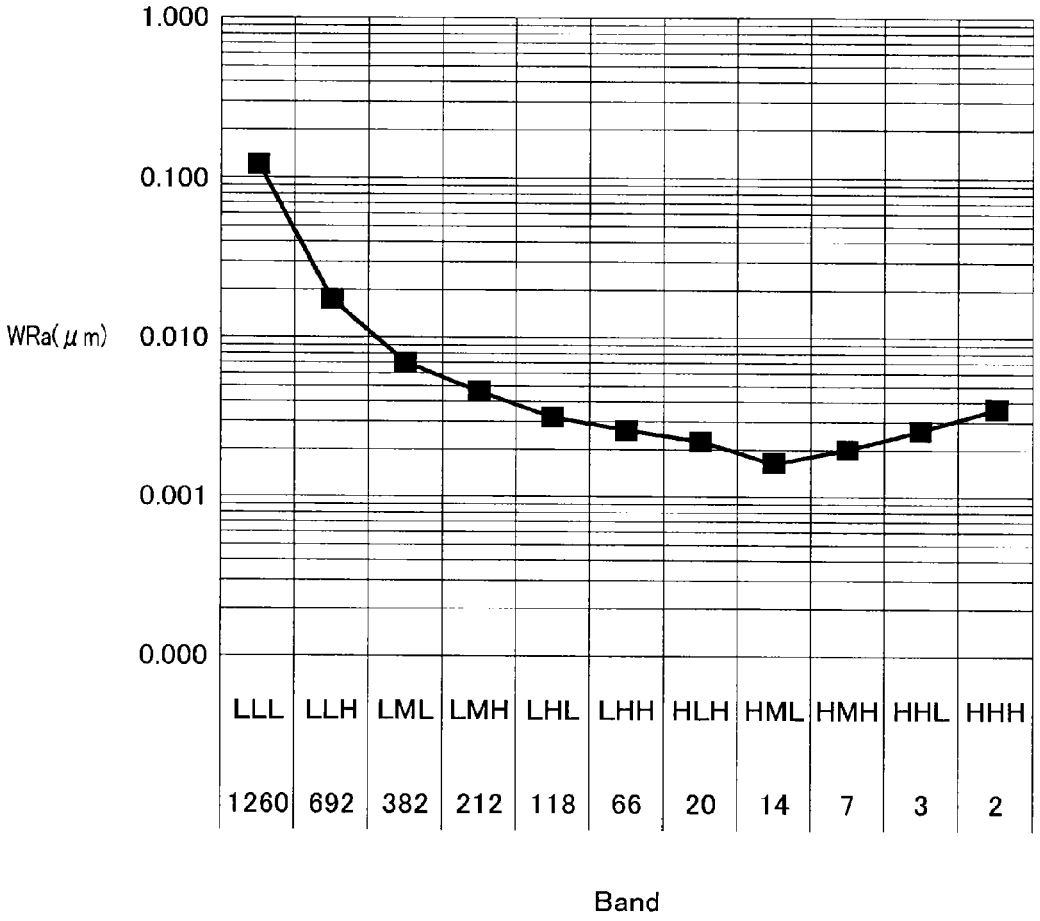
FIG. 9 is a graph showing surface roughness spectrum according to the embodiment of the present invention.

FIG. 9 is a graph showing the surface roughness spectrum according to the embodiment of the present invention.

The surface profile is determined by evaluating the arithmetic average roughness WRa (LLL) from the 11 arithmetic average roughness without including the arithmetic average roughness WRa (HLL) among the total of 12 arithmetic average roughness. For example, the arithmetic average roughness WRa (LLL) is obtained from the 11 arithmetic average roughness. It is therefore necessary for the photoconductive layer to have an arithmetic average roughness WRa (LLL) of 0.1 μm or more and 0.5 μm or less. The details of the photoconductive layer are described later.

When the photoconductive layer has a laminated layer structure made up of the charge transport layer and the charge generation layer, the charge transport layer has the similar surface profile as the photoconductive layer. It is preferable for the arithmetic average roughness WRa (LML) and WRa (LHL) obtained by the first and second wavelet transformation multiresolution analysis to be within the above ranges. It is therefore preferable for the charge transport layer to have an arithmetic average roughness WRa (LLL) of 0.1 μm or more and 0.5 μm or less.

A method of manufacturing the photoconductor is hereinafter described. The photoconductor is manufactured with a manufacturing method including at least a process of applying photoconductive layer coating liquid and a process of drying the liquid. It is preferable for the manufacturing method to be a method of forming the charge transport layer by immersion coating. The manufacturing method may include another process according to needs. A temperature and time for drying the liquid is not limited, and can be changed according to needs. The temperature is preferably from 100 to 150° C., and the time is preferably from 20 minutes to 1 hour. The value of the arithmetic average roughness WRa (LLL) of the photoconductor can be adjusted by adjusting coating intervals based on the above temperature, time, and coating speed.

The photoconductive layer coating liquid may be directly applied on the photoconductor supporting body or may be applied on another layer such as an intermediate layer. When the photoconductive layer has the laminated structure, the charge generation layer coating liquid is firstly applied on the conductive supporting body. After the charge generation layer is formed, the charge transport layer coating liquid is applied to form the charge transport layer.

The above manufacturing method reduces impact on the surface of the photoconductive layer compared to a manufacturing method with a spray coating process. The profile by the addition of the filler can be formed on the surface of the photoconductive layer with the above manufacturing method.

Figure 10:
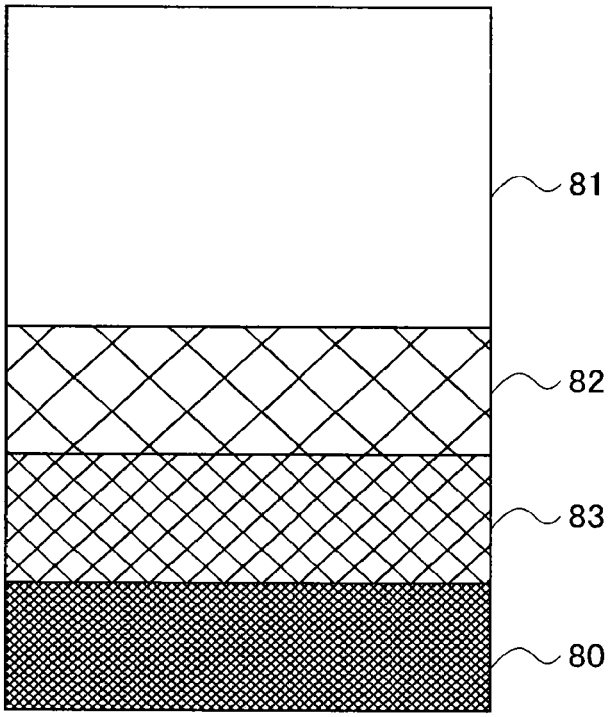
FIG. 10 is a sectional view showing a configuration of the photoconductor according to the embodiment of the present invention.

Hereinafter, the photoconductor according to the embodiment of the present invention is described. FIG. 10 is a sectional view showing the configuration of the photoconductor according to the embodiment of the present invention. FIG. 10 is the sectional view showing the surface of the photoconductor. FIG. 10 shows the photoconductor including the conductive supporting body 80, charge transport layer 81, charge generation layer 82, and intermediate layer 83. As illustrated in FIG. 10, the photoconductor includes the photoconductive layers on the conductive supporting body 80. It is preferable for the photoconductor to have the intermediate layer 83 as shown in FIG. 10. The photoconductive layer has the charge transport layer 81 and the charge generation layer 82 laminated thereon.

Hereinafter, the conductive supporting body according to the embodiment of the present invention is described. The conductive supporting body 80 includes a material having a volume resistance of $10^{10}$ Ω·cm or less. Specific examples of such a material include, but are not limited to, plastic films, plastic cylinders, and paper sheets, on the surface of which metal such as aluminum, nickel, chrome, nichrome, copper, silver, gold, platinum, and iron, or oxide metal such as tin oxide and indium oxide, is formed by deposition or sputtering. In addition, a metal cylinder can also be used as the conductive supporting body 80, which is prepared by tubing metal such as aluminum, aluminum alloy, nickel, and stainless steel by a method such as a drawing ironing (DI) method, impact ironing (II) method, extruded ironing (EI) method, extruded drawing (ED) method, and then treating the surface of the tube by cutting, super finishing, polishing, and the like treatments.

The aluminum tube is made of aluminum alloy such as JIS 3003, JIS 5000, and JIS 6000 with EI method, ED method, DI method, or II method. The surface of the aluminum tube is cut, grinded by a diamond tool, or anodized.

A nickel endless belt or a stainless endless belt disclosed in Japanese Laid-Open Patent Application No. S52-36016 is used for the conductive supporting body 80.

An uncut aluminum tube may be used for the conductive supporting body 80 for reducing costs. In this case, the uncut aluminum tube is obtained by molding an aluminum circular plate into a cup by a drawing process, and the outer surface of the cup is processed by an ironing process as described in Japanese Laid-Open Patent Application No. H03-192265. Namely, the uncut aluminum tube is an II tube finished by the ironing process, an EI tube in which the outer surface of the aluminum extruded tube is finished by the ironing process, or an ED tube to which a cold drawing process is conducted after an extruding process. When these uncut aluminum tubes are used for the photoconductor, a high quality image with less moiré can be obtained. When these uncut aluminum tubes are used for the photoconductor, the durability of the photoconductor can be improved.

The intermediate layer 83 is provided between the conductive supporting body 80 and the photoconductive layer in the photoconductor. The adhesion property and coating property of an upper layer can be improved and the moiré and the amount of electric charge injection from the conductive supporting body 80 can be reduced by providing the intermediate layer 83, so that black dots or dusts on an image can be reduced.

The intermediate layer according to the embodiment of the present invention is hereinafter described. The intermediate layer 83 can be formed by using intermediate layer coating liquid including metal oxide and binder resin in solvent. In addition, the binder resin may be referred to as binding resin or resin. The intermediate layer 83 can be formed by appropriately drying the intermediate layer coating liquid and overcoating the liquid. In this case, when cyclohexane is mixed with the intermediate layer coating liquid, the intermediate coating layer 83 can be easily formed due to the function of the boiling point and the viscosity degree of the cyclohexane.

The metal oxide includes for example, oxidized titanium, zinc oxide, or surface processed oxidized titanium or zinc oxide.

The intermediate layer 83 includes the metal oxide and the binder resin as main components. The photoconductive layer is applied on these components by solvent. Resin having a high solvent resistance to organic solvent is preferable for the intermediate layer 83. Specific examples of such resin include, but are not limited to, water-soluble resin such as polyvinyl alcohol, casein, and sodium polyacryate, alcohol-soluble resin such as copolymerized nylon and methoxymethylated nylon, and curable resin forming a three-dimensional network such as polyurethane, melamine resin, phenol resin, alkyd-melamine resin, and epoxy resin.

It is preferable for the weight ratio of the metal oxide and the resin to be metal oxide/resin=3/1 to 8/1. When the weight ratio is less than 3/1, the carrier transport performance of the intermediate layer 83 may be deteriorated. In this case, the residual potential may be generated or a light responsiveness may be deteriorated. On the other hand, when the weight ratio exceeds 8/1, the space in the intermediate layer 83 may be increased. In this case, when the photoconductive layer is coated on the intermediate layer 83, bubble may be generated.

The thickness (μm) of the intermediate layer 83 is preferably from 0.8 to 10, and more preferably from 1 to 5.

The photoconductive layer according to the embodiment of the present invention is hereinafter described. The photoconductive layer includes a laminated structure or a single layer structure. The laminated structure and the single layer structure do not have the limited number of layers. The laminated structure includes the charge generation layer 82 having a charge generation function and the charge transport layer 81 having a charge transport function. The single layer structure includes a layer having the charge generation function and the charge transport function.

The charge generation layer according to the embodiment of the present invention is hereinafter described. The charge generation layer 82 includes at least a charge generation substance, and contains binding resin according to needs.

Specific examples of the binding resin for the charge generation layer 82 include, but are not limited to, polyamide, polyurethane, epoxy resin, polyketone, polycarbonate, silicone resin, acrylate resin, polyvinylbutyral, polyvinyl formal, polyvinylketone, polystyrene, polysulfone, poly-N-vinylcarbazole, polyacrylamide, polyvinyl benzal, polyester, phenoxy resin, vinylchloide-vinyl acetate copolymer, polyvinylacetate, polyphenylen oxide, polyamide, polyvinylpyridine, cellulosic resin, casein, polyvinylalcohol, and polyvinylpyrrolidone.

The amount of binding resin is from 0 to 500 parts by weight relative to the charge generation substance of 100 parts by weight, and preferably from 10 to 300 parts by weight.

Specific examples of the charge generation substance include, but are not limited to, phthalocyanine pigment such as metallic phthalocyanine and metal-free phthelocyanine, azulenium salt pigment, squaric acid methine pigment, perylene pigment, anthraquinone or polycyclicquinone pigment, quinoneimine pigment, diphenylmethane and triphenylmethane pigment, benzoquinone and naphthoquinone pigment, cyanine and azomethine pigment, indigoid pigment, bisbenzimidazole pigment, and azo pigment such as monoazo pigment, bisazo pigment, asymmetric disazo pigment, trisazo pigment, and tetrazo pigment.

The charge generation layer 82 can be formed by applying the charge generation coating liquid onto the intermediate layer 83 and drying the liquid.

The coating liquid includes at least the charge generation substance. The coating liquid is prepared by dispersing the binding resin in the solvent as appropriate with a ball mill, attritor, sand mill, or ultrasound.

Specific examples of the solvent include, but are not limited to, isopropanol, acetone, methyethyl ketone, cyclohexanone, tetrahydorofuran, dioxane, dioxolane, ethyl cell solve, ethyl acetate, methylacetate, dichloromethane, dichloroethane, monochlorobenzene, cyclohexane, toluene, xylene, and ligroin.

The coating method includes for example, a dip coating method, spray coating method, beat coating method, nozzle coating method, spinner coating method, and ring coating method.

The thickness (μm) of the charge generation layer 82 is preferably from about 0.01 to 5, and more preferably from 0.1 to 2.

The charge transport layer according to the embodiment of the present invention is hereinafter described. The charge transport layer 81 includes a charge transport substance as the main component. The charge transport layer 81 is formed by applying the charge transport layer coating liquid onto the charge generation layer 82, and drying the liquid. The charge transport layer 81 may be formed with at least two layers each having a different material.

It is preferable for the charge transportation layer 81 to contain filler. The average particle diameter (μm) of the filler is preferably 0.3 or more and 3 or less. The amount of filler (%) is preferably from 3 to 10 with respect to the binder resin contained in the charge transport layer. Background fog or toner filming can be therefore improved.

Specific examples of the filler include, but are not limited to, MSP-SN05 manufactured by NIKKO RICA CORPORATION, TOSPEARL™ 120, TOSPEARL™ 130 manufactured by Momentive Performance Material Inc., AA03, AA05, AA07, AA1.5, and AA3 manufactured by Sumitomo Chemical Co., Ltd.

The charge transport layer coating liquid can be prepared by melting or dispersing the charge transport substance and the binder resin in the solvent.

Specific examples of the solvent include, but are not limited to, tetrahydrofuran, dioxane, dioxolan, anisole, toluene, monochlorobenzen, dichloroethane, methylene chloride, and cyclohexanone.

The charge transport substance includes a hole transport substance and an electron transport substance.

Specific examples of the electron transport substance include, but are not limited to, an electron accepting substance such as chloranil, bromanil, tetracyanoethylene, tetracyanoquinodimethane, 2, 4, 7-trinitro-9-fluorenon, 2, 4, 5, 7-tetranitroxanthone, 2, 4, 8-trinitrothioxanthone, 2, 6, 8-trinitro-4H-indeno [1, 2-b]thiophene-4-on, 1, 3, 7-trinitrodibenzothiophene-5, 5-dioxide, 3, 5-dimethyl-3', 5'-ditertiary-butyl-4, 4'-diphenoquinone, and another benzoquinone derivative. The electron transport substances can be used alone or in combination.

Specific examples of the hole transport substance include, but are not limited to, poly-N-vinylcarbazole and the derivative, poly-γ-carbazolylethylglutamate and the derivative, pyrene-formaldehyde condensate and the derivative, polyvinylpyrene, polyvinylphenanthrene, polysilane, oxazole derivative, oxiadiazole derivative, imidazole derivative, monoarylamine derivative, diarylamine derivative, triarylamine derivative, stilbene derivative, α-phenylstillbene derivative, benzidine derivative, diarylmethane derivative, triarylmethane derivative, 9-stryrylanthracene derivative, pyrazoline derivative, divinylbenzen derivative, hydrazone derivative, indene derivative, butadiene derivative, pyrene derivative, bisstilbene derivative, enamine derivative, thiazole derivative, triazole derivative, phenazine derivative, acridine derivative, benzofuran derivative, benzimidazole derivative, and thiophene derivative. The hole transport substances can be used alone or in combination.

Specific examples of the binder resin for the charge transport layer 81 include, but are not limited to, thermoplastic resin and thermosetting resin such as polystyrene styrene-acrylonitrile copolymer, styrene-butadiene copolymer, styrene-maleic acid anhydride copolymer, polyester, polyvinylchloride, vinylchloride-vinylacetate copolymer, polyvinylacetate, polyvinylidene chloride, polyarylate, phenoxy resin, polycarbonate (bisphenol A or bisphenol Z), acetylcellulose resin, ethylcellulose resin, polyvinylbutyral, polyvinylformal, polyvinyl toluene, poly-N-vinylcarbazole, acrylic resin, silicone resin, epoxy resin, melamine resin, urethane resin, phenol resin, alkyd resin, and various polycarbonate copolymers (refer to Japanese Laid Open Patent Application Nos. H05-158250 and H06-51544, for example).

It is preferable for the binding resin to be the thermoplastic resin. Since the bisphenol Z polycarbonate has strong machine strength and a preferable charging performance and a preferable sensitive property for the photoconductor, it is preferable for the binding resin to be the bisphenol Z polycarbonate. It is more preferable for the binding resin to be the bisphenol Z polycarbonate having a viscosity average molecular weight of 40,000 or more and less than 50,000 since such the bisphenol Z polycarbonate improves a tribology property of the photoconductor and the cleaning blade, and has an advantage for forming a surface profile. It is further preferable for the binding resin to be TS-2050 manufactured by Teijin Chemicals™ Ltd or UPILON Z 500 manufactured by Mitsubishi™ Engineering Plastics Ltd.

The binding resin for use in the charge transport layer 81 may include a high molecular charge transport substance having a function as the binding resin and a function as the charge transport substance. Such a high molecular charge transport substance includes the following compounds (a) to (d).

(a) Polymer having carbazole ring in main chain and/or side chain (for example, poly-N-vinylcarbazole, and compounds described in Japanese Laid-Open Patent Application Nos. S50-82056, S54-9632, S54-11737, and H04-183719)

(b) Polymer having a hydrazine structure in main chain and/or side chain (for example, compounds described in Japanese Laid-Open Patent Application Nos. S57-78402 and H03-50555)

(c) Polysilylene polymer (for example, compounds described in Japanese Laid-Open Patent Application Nos. S63-285552, H05-19497, and H05-70595)

(d) Polymer having a tertiary amine structure in main chain and/or side chain (for example, N, N-bis (4-methylphenyl)-4-aminopolyestyrene, and compounds described in Japanese Laid-Open Patent Application Nos. H01-13061, H01-19049, H01-1728, H01-105260, H02-167335, H05-66598, and H05-40350)

It is preferable for the amount of binding resin to be from 0 to 200 parts by weight relative to the charge transport substance of 100 parts by weight.

It is preferable to add plasticizer, leveling agent, or antioxidant into the charge transport layer 81. It is more preferable to add the plasticizer into the charge transport layer 81.

Specific examples of the plasticizer include, but are not limited to, halogenated paraffine, dimethylnaphthalene, dibutylphthalate, diotylphthalate, tricresylphosphate, and copolymer and polymer such as polyester. Since 1, 4-bis (2, 5-dimethylbenzyl) benzene improves a tribology property of the photoconductor and the cleaning blade, and is effective for forming a surface profile, it is preferable to use such benzene. Since 1, 4-bis (2, 5-dimethylbenzyl) benzene is also effective for improving a gas barrier performance, improves a gas resistance property of the photoconductor, and is especially effective for a sensitive property of the photoconductor, it is preferable to use such benzene. It is preferable for the amount of plasticizer to be 30 or less parts by weight with respect to the binder resin of 100 parts by weight.

Specific examples of the leveling agent include, but are not limited to, silicone oil such as dimethyl silicone oil and methylphenyl silicone oil, and polymer or oligomer having perfluoroalkyl group in side chain. It is preferable for the amount of leveling agent to be 1 or less parts by weight relative to the binder resin of 100 parts by weight.

The antioxidant may be added to the charge transport layer 81 to improve an environment resistance to oxidized gas such as ozone.NOx. The antioxidant may be added to any layer including an organic material. It is preferable for the antioxidant to be added to the layer containing the charge transport substance.

Specific examples of the antioxidant include, but are not limited to, hindered phenol-based compound, sulfur-based compound, phosphorus-based compound, bindadoamin-based compound, pyridine derivative, piperidine derivative, and morpholine derivative. In addition, it is preferable for the amount of antioxidant to be 5 or less parts by weight relative to the binding resin of 100 parts by weight.

The thickness (μm) of the charge transport layer 81 formed as described above is preferably from about 5 to 50, more preferably, from 20 to 40, and further preferably from 25 to 35.

In addition, when the photoconductive layer has a single layer structure, thermosetting resin, thermoplastic resin, plasticizer, leveling agent, or antioxidant may be added to the photoconductive layer.

Another intermediate layer uses resin as the main component. Specific examples of the resin include, but are not limited to, polyamide, alcohol-soluble nylon resin, water-soluble butyral resin, polyvinylbutyral, and polyvinylalchol. The above-described coating method can be used for forming this intermediate layer. In addition, the thickness (μm) of the intermediate layer is preferably from 0.05 to 2.

The following Examples 1 to 8 as the examples of the photoconductor according to the embodiment of the present invention show the evaluation results.

Example 1

Example 1 shows an aluminum drum having a thickness of 0.8 mm, a length of 340 mm, and an outer dimeter of ϕ 30 mm, as a photoconductor, on which intermediate layer coating liquid, charge generation layer coating liquid, and charge transport layer coating liquid each having the following composition were sequentially coated and dried in this order. Thus, an intermediate layer having a thickness of 1 μm, a charge generation layer having a thickness of 0.5 μm, and a charge transport layer having a thickness of 24 μm were formed on the aluminum drum.

(Intermediate Layer)

The intermediate layer coating liquid was manufactured by dispersing mixture made from the following compositions with a ball mill for 12 hours.

The compositions of the intermediate layer coating liquid are as follows.

Titanium oxide (purity: 99.7%, rutilated ratio: 99.1%, average primary particle diameter: 0.25 μm):150 parts by weight Alkyd resin (becolite M6401-50-S (solid content 50%) manufactured by D1C Ltd.: 84 parts by weight Melamine resin (Super Beckamine G-821-60 (solid content 60%) manufactured by DIC Ltd.: 47 parts by weight Methylethylketone: 1330 parts by weight The obtained intermediate layer coating liquid was coated on the cut aluminum tube having an outer diameter of ϕ 30 mm and a length of 340 mm, and then dried at 140° C. for 35 minutes. Thus, the intermediate layer having a thickness of 1 μm was formed.

(Charge Generation Layer)

The charge generation layer coating liquid was manufactured by dispersing the mixture made from the following compositions with the ball mill for 12 hours.

Charge generation material: titanylphtalocyanine pigment: 12 parts by weight

The titanylphtalocyanine pigment has the maximum peak at 27.2±0.2° as the Bragg angle 2θ, a peak at 7.3±0.2° as the smallest angle, a no peak at 7.4 to 9.4°, and a no peak at 26.3° in an x-ray diffraction spectrum using CuKα rays.

Binding resin: Polyvinylbutyral (BM-1): 6 parts by weight

Solvent: Methylethylketone: 450 parts by weight

The obtained charge generation layer coating liquid was coated on the intermediate layer, and thus the charge generation layer having a thickness of 0.5 μm was formed.

(Charge Transport Layer)

The charge transport layer coating liquid was manufactured by solving the following compositions.

The compositions of the charge transport layer coating liquid are as follows. Charge transport material: compound shown in the following structural formula (X), 56 parts by weight.

(X)

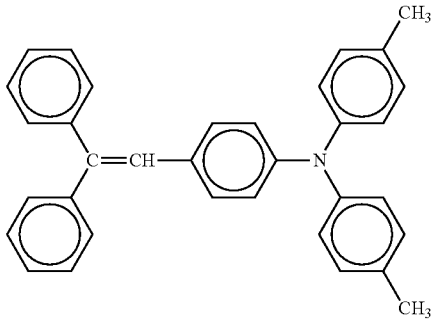

Binding resin: Polycarbonate resin (TS-2050 manufactured by Teijin Chemicals Ltd., viscosity-average molecular weight 50,000): 80 parts by weight Filler: Silicone resin filler having an average particle diameter of 2.0 μm: 4 parts by weight (5% relative to resin amount).

Solvent: Tetrahydrofuran: 560 parts by weight

The obtained charge transport layer coating liquid was applied on the charge generation layer, and dried at 140° C. for 40 minutes to form the charge transport layer having an average thickness of 24 μm. Thus, the photoconductor was manufactured.

The surface profile of the photoconductor had an arithmetic average roughness WRa (LLL) of 0.153 μm.

Example 2

Example 2 shows the photoconductor manufactured by the similar conditions as Example 1 except that the filler in the charge transport layer was silicone resin filler having an average particle diameter of 2.0 μm and an additive amount of 7.2 parts by weight (9% relative to resin amount).

The surface profile of the photoconductor had an arithmetic average roughness WRa (LLL) of 0.480 μm.

Example 3

Example 3 shows the photoconductor manufactured by the similar conditions to Example 1 except that the filler in the charge transport layer was silicone resin filler having an average particle diameter of 2.0 μm and an additive amount of 2.4 parts by weight (3.0% relative to resin amount).

The surface profile of the photoconductor had an arithmetic average roughness WRa (LLL) of 0.138 μm.

Example 4

Example 4 shows the photoconductor manufactured by the similar conditions to Example 1 except that the filler in the charge transport layer was silicone resin filler having an average particle diameter of 3.0 μm and an additive amount of 4 parts by weight (5% relative to resin amount).

The surface profile of the photoconductor had an arithmetic average roughness WRa (LLL) of 0.168 μm.

Example 5

Example 5 shows an the photoconductor manufactured by the similar conditions to Example 1 except that the filler in the charge transport layer was silicone resin filler having an average particle diameter of 0.5 μm and an additive amount of 4 parts by weight (5% relative to resin amount).

The surface profile of the photoconductor had an arithmetic average roughness WRa (LLL) of 0.121 μm.

Example 6

Example 6 shows the photoconductor manufactured by the similar conditions to Example 1 except that the filler in the charge transport layer was α-alumina filler having an average particle diameter of 0.7 μm and an additive amount of 4 parts by weight (5% relative to resin amount).

The surface profile of the photoconductor had an arithmetic average roughness WRa (LLL) of 0.167 μm.

Example 7

Example 7 shows the photoconductor manufactured by the similar conditions to Example 1 except that the filler in the charge transport layer was α-alumina filler having an average particle diameter of 3.0 μm and an additive amount of 4 parts by weight (5% relative to resin amount).

The surface profile of the photoconductor had an arithmetic average roughness WRa (LLL) of 0.173 μm.

Example 8

Example 8 shows the photoconductor manufactured by the similar conditions to those in Example 1 except that the filler in the charge transport layer was α-alumina filler having an average particle diameter of 0.3 μm and an additive amount of 2.4 parts by weight (3% relative to resin amount).

The surface profile of the photoconductor had an arithmetic average roughness WRa (LLL) of 0.102 μm.

Comparative Example 1

Comparative Example 1 shows the photoconductor manufactured by the similar conditions to Example 1 except that the filler in the charge transport layer was silicone filler having an average particle diameter of 2.0 μm and an additive amount of 1.6 parts by weight (2.0% relative to resin amount).

The surface profile of the photoconductor had an arithmetic average roughness WRa (LLL) of 0.089 μm.

Comparative Example 2

Comparative Example 2 shows the photoconductor manufactured by the similar conditions to Example 1 except that the filler in the charge transport layer was silicone filler having an average particle diameter of 2.0 μm and an additive amount of 9.6 parts by weight (12.0% relative to resin amount).

The surface profile of the photoconductor had an arithmetic average roughness WRa (LLL) of 0.681 μm.

Comparative Example 3

Comparative Example 3 shows the photoconductor manufactured by the similar conditions to Example 1 except that the filler in the charge transport layer was silicone filler having an average particle diameter of 0.2 μm and an additive amount of 4 parts by weight (5.0% relative to resin amount).

The surface profile of the photoconductor had an arithmetic average roughness WRa (LLL) of 0.07 μm.

Comparative Example 4

Comparative Example 4 shows the photoconductor manufactured by the similar conditions to Example 1 except that the filler in the charge transport layer was silicone filler having an average particle diameter of 0.2 μm and an additive amount of 8 parts by weight (10.0% relative to resin amount).

The surface profile of the photoconductor had an arithmetic average roughness WRa (LLL) of 0.095 μm.

Comparative Example 5

Comparative Example 5 shows the photoconductor manufactured by the similar conditions to Example 1 except that the filler in the charge transport layer was silicone filler having an average particle diameter of 5.0 μm and an additive amount of 4 parts by weight (5.0% relative to resin amount).

The surface profile of the photoconductor had an arithmetic average roughness WRa (LLL) of 0.78 μm.

Comparative Example 6

Comparative Example 6 shows the photoconductor manufactured by the similar conditions to Example 1 with no addition of filler in the charge transport layer.

The surface profile of the photoconductor had an arithmetic average roughness WRa (LLL) of 0.047 μm Hereinafter a method of evaluating the photoconductor is described. The following Table 2 shows evaluation results of the photoconductors according to Examples 1 to 8, the photoconductors according to Comparative Examples 1 to 6, and the image-forming apparatus using the photoconductors based on the following tests (1) and (2).

(1) Measurement of Surface Profile of Photoconductive Layer (Charge Transport Layer) of Photoconductor The profile curve of the photoconductive layer (charge transport layer) of the photoconductor was measured with a surface roughness and profile shape measuring instrument (Surfcom 1400D manufactured by Tokyo Seimitsu Electron Ltd.). In addition, the measurement conditions are as follows: pickup of E-DT-S02A, measurement length of 12 mm, sampling point of 30,720, and measurement speed of 0.06 mm/s. An arbitrary one point of the freshly-manufactured photoconductor in the circumference direction was measured at intervals of 194 mm from the end portion, so as to measure the profile curve.

Next, in the evaluation, the PC 74 shown in FIG. 4 conducted the first wavelet transformation multiresolution analysis to the one-dimensional data array of the surface profile of the photoconductor obtained by the measurement to separate the data array into the first (HHH) to sixth (HLL) frequency components. Then, the PC 74 generated one-dimensional data array in which the one-dimensional data array of the obtained sixth frequency component (HLL) was thinned such that the number of data arrays is reduced to 1/40. Next, the PC 74 conducted the second wavelet transformation multiresolution analysis to the thinned one-dimensional data array to separate the data array into 6 frequency components of the seventh (LHH) to twelfth (LLL) frequency components. The PC 74 calculated the arithmetic average roughness for each of the obtained 12 frequency components.

In the evaluation, the surface roughness and profile shape measurement instrument measured the surface profile of the photoconductor in 4 positions at intervals of 70 mm. The PC 74 calculated the arithmetic average roughness for each frequency component in each position.

In the evaluation, the PC 74 used Wavelet Too box of MATLAB™ manufactured by The Mathworks for the wavelet transformation. As described above, in the evaluation, the PC 74 conducted the wavelet transformation twice.

In the evaluation results, the average value of the arithmetic average roughness for each frequency component in 4 positions was used as the arithmetic average roughness WRa of each frequency component of the measurement result.

(2) Cleaning Test

A cleaning test was performed to the photoconductors manufactured as described above. The photoconductors were mounted on IPSIO™ SP-C730 manufactured by RICOH Ltd. The cleaning test was performed by continuously printing on 20,000 sheets a text image pattern having an image concentration of 5% under an environment of 25° C. 55% RH. Ricoh My Paper A4 was used for the printing paper. The cleaning test was conducted by developing on the entire surface of the A4 sheet. In addition, genuine products were used for the toner and developer. The cleaning test was conducted by evaluating the images (white image and black image) at 1,000 sheets intervals, and a defect image was evaluated.

Evaluation Index

White image: black point/background fog

Black image: image missing/toner filming

The evaluation results are shown in the following Table 2.

TABLE 2

| | FILLER | PARTICLE DIAMETER | CONCENTRATION | LLL | SCUMMING | TONER FILMING |
|---|---|---|---|---|---|---|
| EXAMPLE | | | | | | |
| 1 | SILICONE | 2 μm | 5% | 0.153 | ○ | ○ |
| 2 | SILICONE | 2 μm | 9% | 0.480 | ○ | ○ |
| 3 | SILICONE | 2 μm | 3% | 0.138 | ○ | ○ |

TABLE 2-continued

| | FILLER | PARTICLE DIAMETER | CONCENTRATION | LLL | SCUMMING | TONER FILMING |
|---|---|---|---|---|---|---|
| 4 | SILICONE | 3 μm | 5% | 0.168 | ○ | ○ |
| 5 | SILICONE | 0.5 μm | 5% | 0.121 | ○ | ○ |
| 6 | ALUMINA | 0.7 μm | 5% | 0.167 | ○ | ○ |
| 7 | ALUMINA | 3.0 μm | 5% | 0.173 | ○ | ○ |
| 8 | ALUMINA | 0.3 μm | 3% | 0.102 | ○ | ○ |
| COMPARATIVE EXAMPLE | | | | | | |
| 1 | SILICONE | 2 μm | 2% | 0.089 | ○ | X |
| 2 | SILICONE | 2 μm | 12% | 0.681 | X | ○ |
| 3 | SILICONE | 0.2 μm | 5% | 0.070 | ○ | X |
| 4 | SILICONE | 0.2 μm | 10% | 0.095 | ○ | X |
| 5 | SILICONE | 5.0 μm | 5% | 0.780 | X | X |
| 6 | | | 0% | 0.047 | ○ | X |

According to the evaluation results shown in Table 2, it is confirmed that the photoconductors having the arithmetic average roughness WRa (LLL) of 0.1 μm or more and 0.5 μm or less in the surface profile of the charge transport layer form high-quality images with less defect images.

As shown in the particle diameter of the filler of Table 2, the arithmetic average roughness WRa (LLL) of 0.1 μm or more and 0.5 μm or less can be obtained by containing the filler having an average particle dimeter of 0.3 μm or more and 3 μm or less in the charge transport layer. In addition, the additive amount of the filler is from 3 to 10% relative to the binder resin contained in the charge transport layer as shown in the filler concentration of Table 2.

The surface profile of the photoconductive layer affects the tribology property with a portion having contact with the surface of the photoconductor. The wettability (adhesive property) with the developer and the share stress along the compressive stress with the cleaning blade using a rubber plate are changed according to the surface profile of the photoconductive layer. For this reason, when the photoconductive layer has a preferable tribology property, a resistance to the background fog can be obtained. The arithmetic average roughness WRa (LLL) is preferably 0.1 μm or more and 0.5 μm or less. When the arithmetic average roughness WRa (LLL) is less than 0.1 toner filming (adhesion of additive agent) easily occurs. On the other hand, when the arithmetic average roughness WRa (LLL) exceeds 0.5 μm, the toner slips through the cleaning blade. Accordingly, a defect image by background fog is obtained.

When the arithmetic average roughness WRa (LLL) is 0.1 μm or more and 0.5 μm or less, the smoothness of the surface of the photoconductor is improved. The smoothness of the cleaning blade used for cleaning the surface of the photoconductor is therefore improved.

A stick-slip phenomenon may occur between the cleaning blade and the surface of the photoconductor. More specifically, according to the stick-slip phenomenon, when the restoring force by the elastic force of the cleaning blade is increased by the maximum static frictional force with the surface of the photoconductor, the cleaning blade moves in a direction of the stored position by the storing force. Next, when the storing force is decreased, the movement of the cleaning blade is stopped. Then, the maximum static frictional force is again increased, so that the cleaning blade moves in the driving direction of the photoconductor. The stick-slip phenomenon occurs by the repetition of these movements When the stick-slip phenomenon occurs, the toner remained on the surface of the photoconductor may slip through. In this case, the toner may not be completely removed by the cleaning blade. Accordingly, the cleaning performance may be deteriorated due to the stick-slip phenomenon. Moreover, the background fog or toner filming may occur by the toner remained on the surface of the photoconductor. In this case, a defect image may be obtained. It is therefore necessary to exchange parts of the image-forming apparatus. The durability of the parts may be deteriorated. Moreover, when the stick-slip phenomenon occurs, the cleaning blade may be deteriorated due to vibration, resulting in deterioration in the durability of the cleaning blade.

On the other hand, the irregularities of the surface of the photoconductor according to the embodiment of the present invention have the arithmetic average roughness WRa (LLL) of 0.1 μm or more and 0.5 μm or less. With this configuration, the cleaning blade stably has contact with the surface of the photoconductor since the vibration of the cleaning blade corresponds to the irregularities of the surface.

Namely, when the arithmetic average roughness WRa (LLL) is 0.1 μm or more and 0.5 μm or less, the smoothness of the surface of the photoconductor can be improved to avoid the occurrence of the stick-slip phenomenon. Thus, the cleaning performance and the durability of the cleaning blade can be improved.

Even when the photoconductor is repeatedly used for a long period of time, a preferable cleaning performance of the cleaning blade can be maintained, and less defect image is obtained. The image-forming apparatus therefore forms a high quality image. When such a photoconductor is used, the image-forming apparatus achieves a high speed, downsizing, a high quality color image, and a simple maintenance performance.

Although the present invention has been described in terms of exemplary embodiment, it is not limited thereto. It should be appreciated that variations or modifications may be made in the embodiment described by persons skilled in the art without departing from the scope of the present invention as defined by the following claims.

What is claimed is:

1. A photoconductor for use in an image-forming apparatus, the photoconductor comprising:

a charge transport layer formed as an outer surface of the photoconductor, the charge transport layer including irregularities having an arithmetic average roughness of 0.1 μm or more and 0.5 μm or less in a cycle length from 867 to 1,654 μm, wherein the charge transport layer contains a thermoplastic resin.

2. The photoconductor according to claim 1, wherein the charge transport layer further contains a filler, the filler has an average particle dimeter of 0.3 μm or more and 3 μm or less, and an additive amount of the filler is from 3 to 10% relative to the thermoplastic resin contained in the charge transport layer.

3. The photoconductor according to claim 1, wherein the irregularities correspond to frequency components obtained by wavelet transformation.

4. The photoconductor according to claim 3, wherein the wavelet transformation obtains the frequency components of 4 or more and 8 or less.

5. An image-forming apparatus comprising:

a photoconductor; and a charge transport layer formed as an outer a surface of the photoconductor, the charge transport layer including irregularities having an arithmetic average roughness of 0.1 μm or more and 0.5 μm or less in a cycle length from 867 to 1,654 μm, wherein the charge transport layer contains a thermoplastic resin.

6. A cartridge comprising:

a photoconductor; and a charge transport layer formed as an outer surface of the photoconductor, the charge transport layer including irregularities having an arithmetic average roughness of 0.1 μm or more and 0.5 μm or less in a cycle length from 867 to 1,654 μm, wherein the charge transport layer contains a thermoplastic resin.

7. The photoconductor according to claim 1, further comprising:

a conductive supporting body positioned below the charge transport layer.

8. The photoconductor according to claim 7, further comprising:

an intermediate layer positioned between the conductive supporting body and the charge transport layer.

9. The photoconductor according to claim 8, further comprising:

a charge generation layer positioned between the charge transport layer and the intermediate layer.

* * * * *